United States Patent [19]

Bueschel

[11] Patent Number: 5,055,818

[45] Date of Patent: Oct. 8, 1991

[54] FLAGGED BLOWN FUSE INDICATOR

[75] Inventor: David M. Bueschel, Menomonee Falls, Wis.

[73] Assignee: Cooper Industries, Inc., Houston, Tex.

[21] Appl. No.: 444,010

[22] Filed: Nov. 30, 1989

[51] Int. Cl.[5] ..... H01H 85/30

[52] U.S. Cl. ..... 337/267; 337/241; 337/244

[58] Field of Search ..... 337/244, 267, 241, 265, 337/206; 116/217, 216, 215

[56] References Cited

U.S. PATENT DOCUMENTS

| | | | |
|---|---|---|---|
| 817,959 | 4/1906 | Craft . | |
| 891,323 | 6/1908 | Brown . | |
| 1,382,989 | 6/1921 | Lee . | |
| 1,782,089 | 11/1930 | Baumer | 337/244 |
| 2,086,406 | 7/1937 | Dieffenbacher . | |
| 2,193,203 | 3/1940 | Mosley | 337/244 |
| 2,239,903 | 4/1941 | Schultz . | |
| 2,413,563 | 12/1946 | Hermann . | |
| 4,323,874 | 4/1982 | Link | 337/244 |
| 4,420,735 | 12/1983 | Muench, Jr. | 337/244 |
| 4,506,249 | 3/1985 | Huber et al. | 337/232 |

*Primary Examiner*—Harold Broome

*Attorney, Agent, or Firm*—Donald Verplancken; Ned L. Conley; David A. Rose

[57] ABSTRACT

The blown fuse indicator is mounted to one of the opposed ferrules of a fuse and ejects a streamer therefrom in response to a blown or open fuse condition. The streamer is a strip of vinyl which is secured at one end to a plunger held within a housing mounted on one of the ferrules, and at its other end to a container which is ejected from the housing by the plunger in response to a fuse opening whereby the streamer unfurls to indicate the fuse is blown and open.

28 Claims, 3 Drawing Sheets

FLAGGED BLOWN FUSE INDICATOR

BACKGROUND OF THE INVENTION

The present invention relates to fuses and more particularly to riser pole fuses.

Riser pole fuses are large capacity fuses which are mounted on poles adjacent transformers, or other power line equipment which require separate power interruption protection. Such fuses are typically located in the power distribution lines at the top of twenty to forty foot poles. The fuses are located at numerous places throughout the power distribution system wherever line or power distribution component protection is required.

When a riser pole fuse opens, it interrupts the power distribution circuit at that point. Opening of the fuse can occur from natural events, such as lightning, or the touching of adjacent live wires from the effect of wind, or line surges caused by the failure of power distribution components.

One major problem associated with riser pole fuses is the identification of the location of a blown, or open fuse in the circuit. The fuse must be replaced in order to reconnect and reinstate that portion of the power distribution system protected by the open fuse into the main electrical distribution system. As the fuses are at the top of poles and several fuses may be located in an area where the power has been interrupted, it is often difficult to identify the open fuse and several fuses must be checked to determine which fuse has in fact opened.

One known method of identifying opened fuses is a colored button or spike, which pops out of a small aperture in one end ferrule of the fuse, to indicate that the fuse has opened. A button is attached to the fusing element of the fuse by a spring loaded ni-chrome wire, and when the fuse blows, the wire breaks and the button protrudes out the end ferrule of the fuse.

The major problem with the button indicator is visual identification. Although the line repair crew can view the fuse and therefore need not climb the pole to determine whether the fuse is opened in clear weather, in bad weather or at night it is difficult or impossible to see the button, rendering it virtually useless. Likewise, as the button is a stiff member which is recessed within the fuse, it has a limited length, i.e. it cannot exceed the length of the fuse and is commonly on the order of one to two inches. As a result, the repair crew must stand in direct visual alignment with the end of the fuse to see the button.

U.S. Pat. No. 891,323, Brown, discloses a blow indicator comprising an accordion shaped fan which flips out from the side of the fuse to indicate an open fuse. To view the fan, the fuse must be aligned such that the fan will eject from the side of the fuse exposed downward toward the repair personnel.

U.S. Pat. No. 817,959, Craft. discloses a spring mounted bar which flips up in the presence of an overcurrent.

U.S. Pat. No. 1,382,989, Lee, discloses a metal triangular flag which protrudes from a fuse box in the event of an overcurrent condition which opens the fuse.

U.S. Pat. No. 2,086,406, Dieffenbacher, discloses a fuse having a metal indicator which flips up to disclose an open fuse. Similar constructions are found in U.S. Pat. No. 2,239,903, Schultz. and 2,413,563, Humann.

The present invention overcomes the deficiencies of these prior art fuses.

SUMMARY OF THE INVENTION

The flagged blown fuse indicator of the present invention includes a flag or streamer packed within a striker assembly cavity. One end of the streamer is affixed to a striker, while the other end of the streamer is affixed to a penetrating cup. In response to a fuse opening condition, the striker will impact upon the penetrating cup, causing the cup to exit from the striker assembly cavity into the atmosphere, extending the streamer therefrom. The streamer serves as a useful, highly visible marking which extends a substantial distance from the fuse to identify an open fuse in a power line.

DESCRIPTION OF THE DRAWINGS

These and other objects and advantages of the invention will become apparent from the following description when read in conjunction with the following drawings wherein.

BRIEF DESCRIPTION OF THE PREFERRED EMBODIMENT

Figure 1:
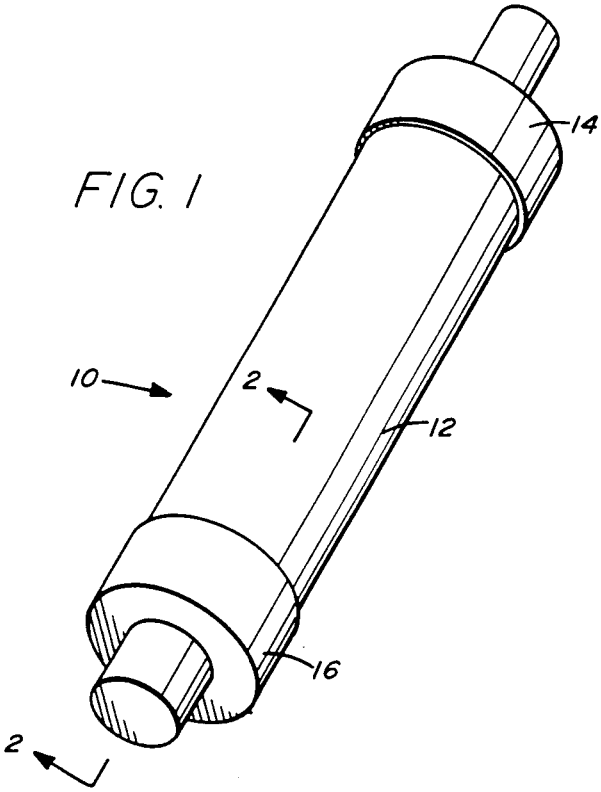
FIG. 1 is a perspective view of the riser pole fuse of the present invention.

Referring initially to FIG. 1, fuse 10 includes a tubular body 12 housing a striker assembly 22 which is actuated upon fuse 10 being blown and opened. The open ends of tubular body 12 are closed by closed-end cylindrical ferrules 14, 16 received over the opposed open ends of body 12. One of the ferrules 14, 16, such as ferrule 16, includes a streamer assembly 18 having a streamer 20 which is released by striker assembly 22 for marking fuse 10 after fuse 10 is blown or opened.

Figure 2:
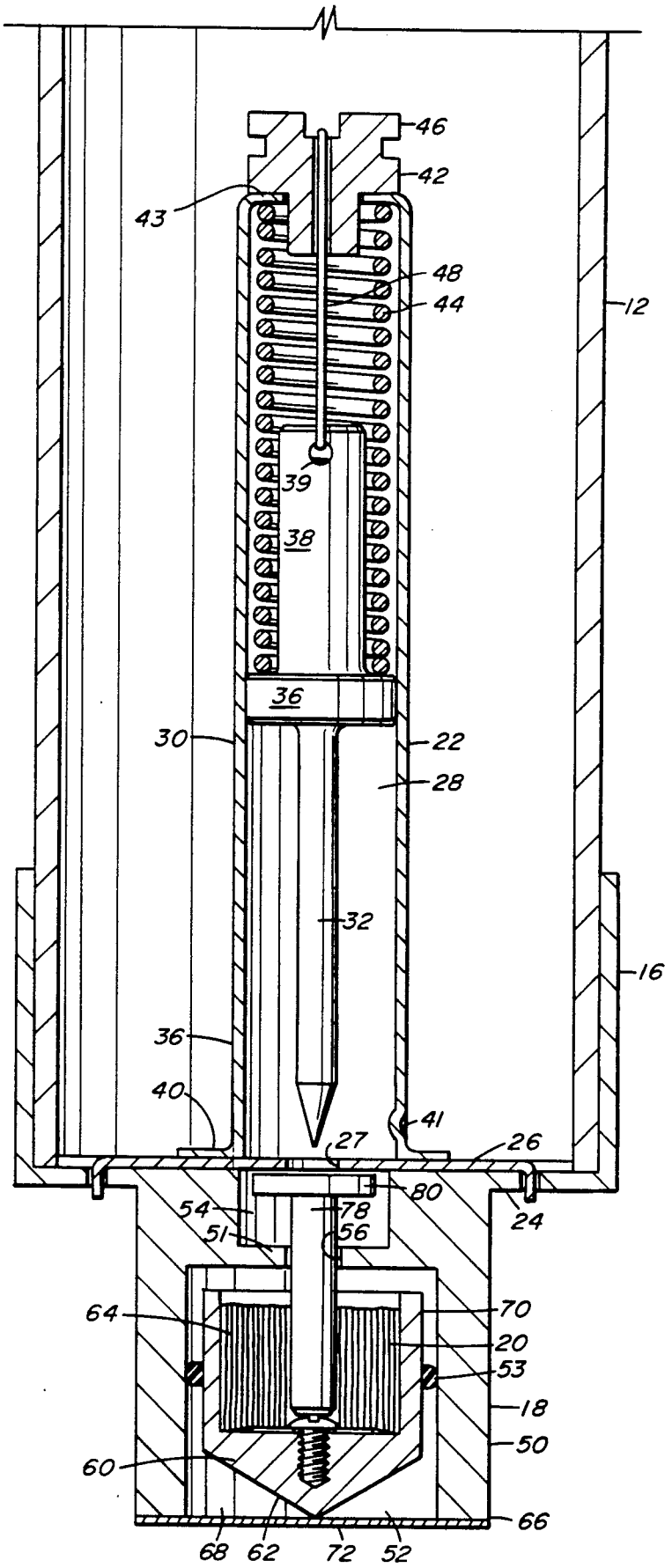
FIG. 2 is a partial sectional view of the fuse of FIG. 1 at 2—2.

Referring now to FIG. 2, striker assembly 22 is a device similar to that used in the prior art to mark blown fuses. Striker assembly 22 includes a striker tube 30 mounted on end 24 of tubular body 12 which is closed by ferrule 16 having streamer assembly 18. A conductive copper plate 26 covers end 24 adjacent ferrule·16 to electrically connect the fusing link (not shown) to ferrule 16. Copper plate 26 includes a hole 27, disposed therethrough substantially in the circumferential center thereof. Striker assembly 22 includes a spring loaded striker 28 reciprocally mounted within striker tube 30. Striker 28 is generally in the shape of a nail having a flanged head 36 and a long continuous shank portion 32 terminating at a point 34 on the end thereof. A tie off strip 38 is a cylindrical extension of head 36 on that side of head 36 opposite shank 32 and includes a tie off hole 39 in its end. Striker 28 and tie off strip 38 are preferably manufactured as a single continuous piece of turned metal such as aluminum. Striker tube 30 includes an outer flange 40 at that end 31 adjacent ferrule 16, an inward projecting dimple 41 adjacent flange 40, and an inwardly projecting annular flange 42 at the other end 43 of tube 30 opposite flange 40. A spring 44 is disposed and captured in tube 30 between head 36 and inward flange 42. The coil of spring 44 receives tie off strip 38.

Spring 44 is compressed between inward flange 42 and head 36 so as to exert a downward force on striker flange head 36 within tube 30. Spring 44 is sized to provide sufficient force to move striker 28 downward within tube 30 such that point 34 of shank 32 will pass through hole 27 causing striker 28 to extend beyond end 24 of tubular fuse body 12. To secure striker 28 within tube 30, a striker line holder 46 is placed in end 43 of tube 30 and a wire 48 is threaded around holder 46 and through hole 39 in tie off strip 38. Wire 48 is sufficiently strong to resist the force of spring 44. However, during a fuse opening, the wire 48 will break, thereby allowing striker 28 to move downwardly as the force of spring 44 acts on head 36, causing striker 28 to pass through hole 2 and project the point 34 of shank 32 past the end 24 of tube 30. Dimple 41 projects into the interior of tube 30 so as to engage head 36 and limit its downward movement within tube 30 and prevent striker 28 from completely exiting tube 30.

Streamer assembly 18 includes a cylindrical retainer housing 50 mounted on end 24 of tubular body 12 coaxially with striker assembly 22. Housing 50 is preferably formed as an integral part of ferrule 16 with ferrule 16 and housing 50 being forged from brass. Housing 50 has a series of coaxial bores for selectively holding and ejecting streamer 20 including a cylindrical streamer bore 52 and a coaxial cylindrical plunger retainer bore 54 interconnected by a coaxial, reduced diameter intermediate bore 56. Streamer bore 52 is a larger diameter bore disposed in the distal end 66 of housing member 50 to hold streamer 20. Bore 52 includes an open aperture 68 opposite intermediate bore 56. To prevent the entry of foreign materials, such as dirt or water, into streamer bore 52, a foil cover 72 is affixed to distal end 66.

As best shown in FIG. 2, streamer assembly 18 includes a cup 60 in which is disposed streamer 20, and a plunger 76, both disposed within housing 50. Cup 60 is a hollowed out cylindrical member, preferably turned aluminum or injection molded plastic. Cup 60 has conical point section 62 at one end and a streamer retainer cavity 64 or hollowed out portion, is included in the other end. Cup 60 has an outer cylindrical surface 70 which surrounds cavity 64 and terminates at conical point section 62.

Figure 3:
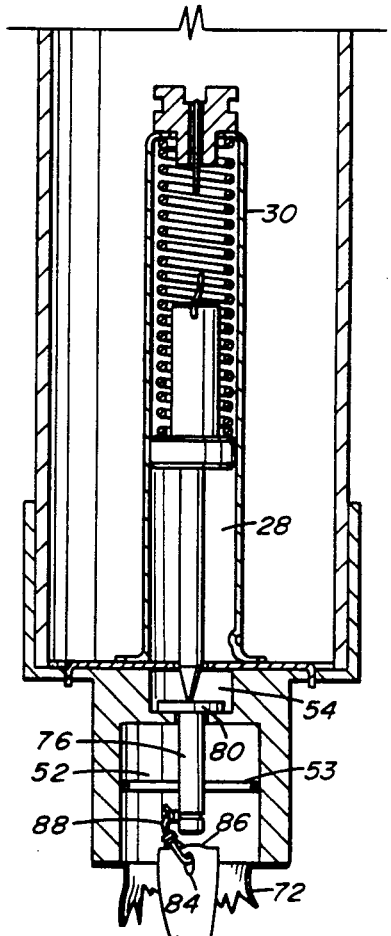
FIG. 3 is a partial sectional view of the fuse of FIG. 1 at 2—2 in the fuse opened position.
Figure 3:
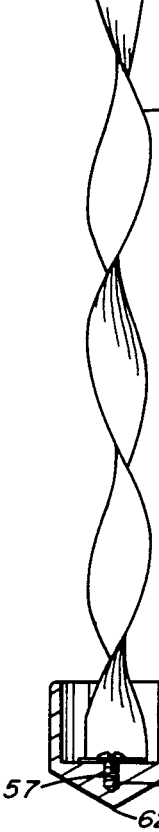

Referring now to FIGS. 2 and 3, streamer 20 is packed within the retainer cavity 64, and one end 66 of streamer is affixed to the cup 60 within retainer cavity 64 by a screw 59. Screw 59 is passed through grommet (not shown) in streamer 20 and then anchored into a threaded hole 57 in cup 60. Cup 60 is disposed within streamer bore 52 of housing 50, with conical point section 62 projecting towards open aperture 68 of bore 52. To secure cup 60 within streamer retainer bore 52, an o-ring 53 interferingly engages the inner surface of streamer bore 52 and outer surface 70 of cup 60.

Plunger 76, having a cylindrical shank 78 terminating in a plunger head 80 at one end thereof, is disposed in plunger retainer bore 54 such that shank 78 extends therefrom through intermediate bore 56 into streamer bore 52. Head 80 is sized to be received within retainer bore 54 and is larger than the diametrical cross-section of intermediate bore 56 so as to prevent the complete passage of plunger 76 through bore 56.

Figure 4:
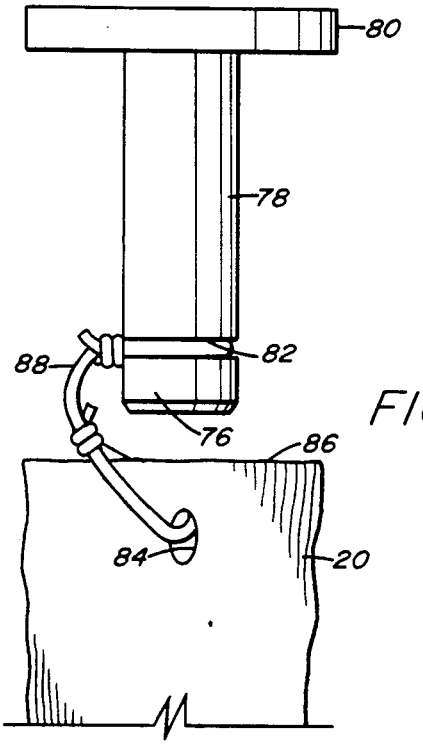
FIG. 4 is a side view of the plunger and streamer of the fuse of FIG. 3.
Figure 5:
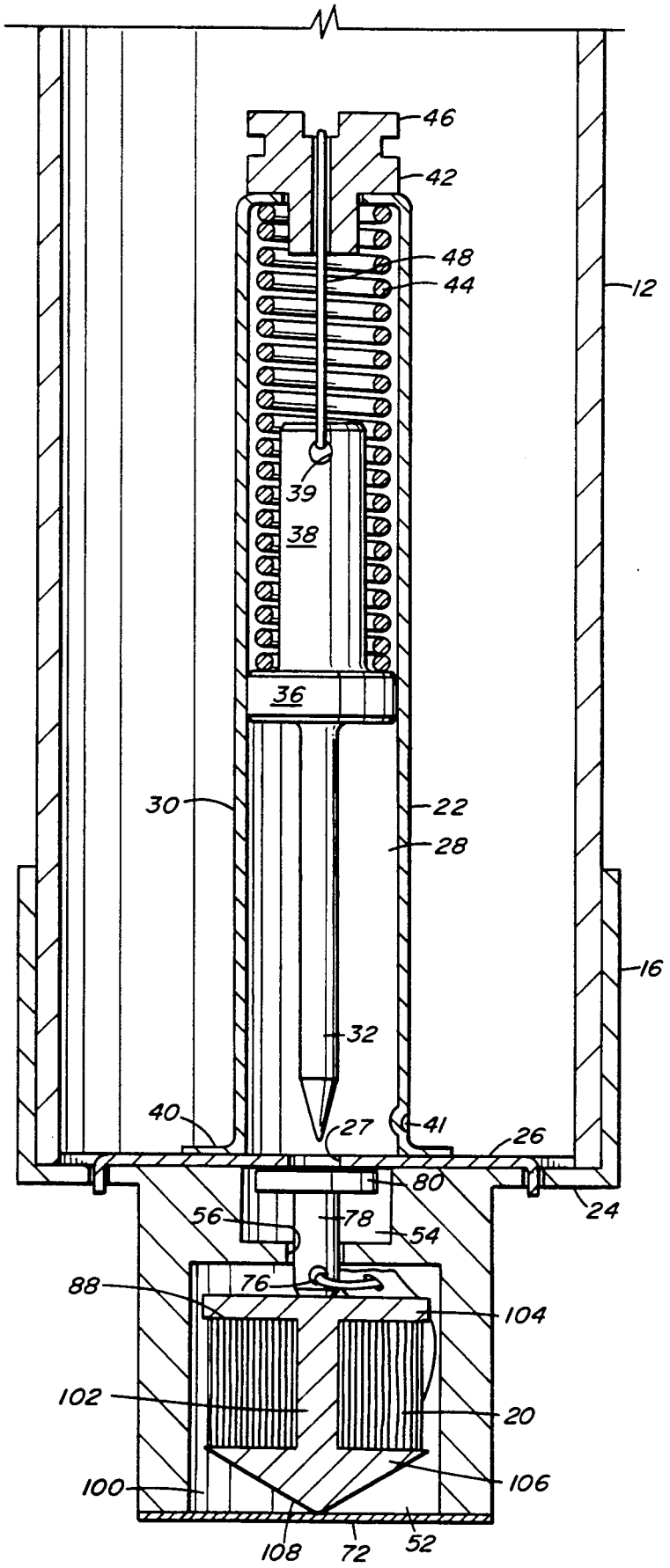
FIG. 5 is a sectional view of an alternative construction of the blown fuse indicator of the present invention.

Referring now to FIG. 4, shank 78 includes a retainer groove 82 at that end opposite head 80 which extends into streamer bore 52. Streamer 20 includes an aperture 84 adjacent end 86 thereof. End 86 of streamer 20 is attached to shank 78 by a string 88 tied through aperture 84 and around retainer groove 82. Other means of attaching the streamer 20 to the plunger 76 may be employed. For example, streamer 20 may be taped to plunger 76, or shank 78 may include a slot therein for receiving the end 86 of streamer therein. Likewise, groove 82 may be eliminated, and a hole 83, as shown in FIG. 5, through which a ring 89 is slipped, substituted in its place. Hole 83 may also be employed with string 88, by tying one end of string to hole 89 and the other end to streamer 20.

Streamer 20 is a strip of non-conductive weather resistant material, preferably a plastic material such as vinyl, approximately 18 inches long. The length of strip 20 is limited only by the size of retainer cavity 64 into which streamer 20 is packed. Streamer 20 is preferably a bright color such as yellow or orange, which is highly visible to repair personnel. After ejection from streamer cavity 52, cup 60 remains attached to streamer 20 and acts as a weight to help prevent the streamer from wrapping around fuse 10 or adjacent objects which would reduce visibility of streamer 20.

Referring again to FIG. 3, in the operation of striker assembly 22 and streamer assembly 18 in response to a fuse opening condition, wire 48 breaks upon fuse 10 blowing and opening thereby releasing striker 28. Spring 44 then actuates striker 28 within tube 30, causing point 34 to pass through hole 27 and impact head 80 of plunger 76. The force of striker 28 against head 80 actuates plunger 76 within plunger retainer bore 54, causing shank 78 to pass through intermediate bore 56 and the end of shank 78 to strike the bottom of cup 60 in streamer bore 52. This impact of cup 60 drives conical point section 62 within bore 52 causing it to penetrate foil 72. Thus cup 60 exits the open end of streamer cavity 52 and out of housing 50. Gravity causes cup 60, with one end of streamer 20 attached thereto, to unfold and fully extend streamer 20 therefrom to indicate that fuse 10 is open and has blown.

Referring now to FIG. 5, an alternative embodiment of the present invention is shown wherein a spool 100 is received within streamer retainer cavity 52 rather than the cup 60 of the preferred embodiment. Spool 100 is preferably manufactured from turned aluminum or injection molded plastic, and includes a central cylindrical portion 102 bounded on one end by a annular impact flange 104 and an annular penetrating flange 106 on the other end. Annular penetrating flange 106 has a conical penetrating face 108 thereon. Spool 100 is disposed within streamer retainer cavity 52 such that annular impact flange 104 faces the end of shank 78 of plunger 76 and annular penetrating flange 106 is disposed adjacent foil 72. Shank portion 102 is diametrically smaller than flanges 104, 106, forming an annular streamer packing cavity 110 disposed circumferentially thereabout.

Streamer 20 is attached at one end thereof to shank portion 102 by a screw or other attachment device (not shown) and the remainder of streamer 20 is wound around shank portion 102 to form a roll. A split ring 89 is attached through aperture 84 in streamer end 86 and passed through a hole 83 disposed through plunger 76.

Upon fuse opening, striker 28 passes through hole 27 and impacts plunger 76, which in turn strikes impact flange 104. Plunger 76 drives spool 100 out of streamer retainer bore 52 and eject spool 100 and streamer 20 from housing 50. As end 86 of streamer 20 is affixed to plunger, streamer 20 will unroll from spool 100 to its full visible length.

Although streamer 20 has been described as a single piece, multi-strand streamers could be employed without deviating from the invention. Likewise, striker 28 and plunger 76 could be a single unitary piece. Although fuse 10 is shown as a cylindrical fuse, the flagged blown fuse indicator may be readily adapted to other fuse configurations.

While a preferred embodiment of the invention has been shown and described, modifications thereof can be made by one skilled in the art without departing from the spirit of the invention.

I claim:

1. An indicator for indicating an opened condition in a fuse having a fuse body, comprising:

a housing adapted for attachment to the fuse body and having a cavity therein;

a weight having a solitary connection means;

a non-rigid streamer packed within said housing cavity and having opposed ends, one of said ends affixed to said housing and the other of said ends affixed to said weight solitary connection means;

retainer means releasably retaining said streamer within said cavity;

actuator means actuated upon the opening of the fuse and releasing said streamer from said retainer means and ejecting said streamer from said cavity;

whereby upon opening of the fuse, said weight is totally ejected from said housing and is supported adjacent said housing only by said streamer.

2. An indicator for indicating an opened condition is a fuse having a fuse body, comprising;

a housing adapted for attachment to the fuse body and having a housing cavity therein;

a non-rigid streamer packed within said housing cavity;

retainer means releasably retaining said streamer within said cavity; and actuator means actuated upon the opening of the fuse and releasing said streamer from said retainer means and ejecting said stream from said cavity;

said actuator means including a striker reciprocally mounted on the fuse body and a biasing means engaging said striker for moving said striker against said retainer means to release said streamer upon the opening of the fuse.

3. The indicator of claim 2, wherein said actuator means further includes a wire holding said striker in an unactuated position, said wire releasing said striker in the opened condition of the fuse, said biasing means moving said striker to an actuated position upon the fuse opening.

4. An indicator for indicating an opened condition is a fuse having a fuse body, comprising:

a housing adapted for attachment to the fuse body and having a cavity;

a plunger reciprocally mounted within said housing cavity;

a streamer packed within said housing cavity;

retainer means releasably retaining said streamer within said cavity;

an actuator means actuated upon the opening of the fuse and releasing said streamer from said retainer means and ejecting said streamer from said cavity;

said actuator means including a striker reciprocally mounted on the fuse body and a biasing means engaging said striker for moving said striker against said retainer means to release said striker upon the opening of the fuse;

said streamer being packed in a container disposed within said cavity, said streamer having opposed first and second ends, said first and being attached to said plunger and said second end being attached to said container.

5. The indicator of claim 4, wherein said plunger impacts said container upon the actuator of said striker in response to a fuse opening condition causing said container with said streamer to eject from said cavity thereby unfurling said streamer.

6. The indicator of claim 4, wherein said plunger includes a head and a shank and said cavity includes a first bore housing said head and a second bore housing a portion of said shank.

7. The indicator of claim 2, wherein said retainer means includes a breakable closure over said cavity, said breakable closure being broken upon actuation of said actuator means.

8. The indicator of claim 2, wherein said streamer is a length of non-conductive material.

9. The indicator of claim 8, wherein said non-conductive material is a thin plastic strip.

10. The indicator of claim 8, wherein said non-conductive material is a vinyl.

11. The fuse of claim 2, further including a cup received in said housing for containing said streamer.

12. The fuse of claim 11, wherein said ejectment means includes a member reciprocally mounted within said housing which reciprocate upon the opening of the fuse to force said streamer out of said housing.

13. The fuse of claim 11, wherein said housing includes an aperture therein, said aperture sealed with a foil.

14. A fuse, comprising:

a fuse body;

a housing having an aperture therein sealed with foil disposed on said fuse body;

a streamer received in said housing and having opposed first and second ends;

an ejectment means for ejecting one end of said streamer from said housing upon said fuse opening;

a cup received in said housing for containing said streamer;

wherein said cup includes a pointed portion disposed adjacent said foil.

15. The fuse of claim 14, wherein said pointed portion penetrates said foil upon the fuse opening.

16. The fuse of claim 14, wherein said pointed portion is conical.

17. A fuse, comprising;

a fuse body;

a housing disposed on said fuse body;

a streamer received in said housing and having opposed first and second ends;

an ejectment means for ejecting one end of said streamer from said housing upon said fuse opening;

wherein said ejectment means includes a striker actuable into said housing in response to a fuse opening condition and a streamer container ejectable from said housing in response to actuation of said striker.

18. The fuse of claim 17, wherein said streamer container is attached to said second end of said streamer.

19. A fuse, comprising:

a insulative tube;

a cylinder mounted within said tube adjacent one end thereof;

a striker reciprocally mounted within said cylinder and having a head end and a point end;

a wire holding said striker in an unactuated position within said cylinder;

means applying a biasing force on said striker to an actuated position;

a ferrule receiving that end of said tube adjacent said cylinder;

said ferrule having a cavity with one end adjacent said cylinder and another end covered with foil;

said cavity having a first bore adjacent said cylinder and a second bore with an aperture extending therebetween;

a plunger reciprocally mounted within said cavity and having a head disposed in said first bore and a shaft extending from said head in said first bore, through said aperture and into said second bore;

a container disposed in said second bore;

a streamer disposed in said container having one end connected to said shaft and another end connected to said container;

whereby upon said fuse opening said wire is broken to release said striker allowing said means to move said striker to said actuated position with said point end striking said head thereby reciprocating said plunger to impact said container driving said container through said foil and permitting said streamer to unfurl to indicate the fuse is open.

20. The indicator of claim 1, wherein said actuator means includes a striker reciprocally mounted on the fuse body and a biasing means on the fuse body biasing said striker toward said streamer and moving said striker upon actuator of said actuator means to overcome said retainer means to release said streamer upon the opening of the fuse.

21. The indicator of claim 20, wherein said actuator means further includes a wire holding said striker in an unactuated position, said wire releasing said striker in the opened condition of the fuse, said biasing means moving said striker to an actuated position upon the fuse opening.

22. The indicator of claim 20, further including a plunger reciprocally mounted within said housing and wherein said streamer is packed in a container disposed within said cavity, said streamer having opposed first and second ends, said first end being attached to said plunger and said second end being attached to said container.

23. The indicator of claim 22, wherein said plunger impacts said container upon the actuation of said striker in response to a fuse opening condition causing said container with said streamer to eject said cavity thereby unfurling said streamer.

24. The indicator of claim 22, wherein said plunger includes a head and a shank and said cavity includes a first bore housing said head and a second bore housing a portion of said shank.

25. The indicator of claim 1, wherein said retainer means includes a breakable closure over said cavity, said breakable closure being broken upon actuation of said actuator means.

26. The indicator of claim 1, wherein said streamer is a length of non-conductive material.

27. The indicator of claim 26, wherein said non-conductive material is a thin plastic strip.

28. The indicator of claim 26, wherein said non-conductive material is vinyl.

* * * * *